United States Patent [19]

Ahmann

[11] 4,297,566

[45] Oct. 27, 1981

[54] PUNCH FRAME FOR DATA REGISTERING DEVICE

[76] Inventor: John E. Ahmann, 1400 Duhig Rd., Napa, Calif. 94558

[21] Appl. No.: 129,585

[22] Filed: Mar. 12, 1980

[51] Int. Cl.[3] ..... G07C 13/00

[52] U.S. Cl. ..... 235/50 R

[58] Field of Search ..... 235/51, 50 R, 50 A, 235/50 B, 52

[56] References Cited

U.S. PATENT DOCUMENTS

| | | | |
|---|---|---|---|
| 3,201,038 | 8/1965 | Harris | 235/50 R |
| 3,240,409 | 3/1966 | Harris | 235/50 R |
| 3,536,257 | 10/1970 | Laws | 235/50 B |

*Primary Examiner*—George H. Miller, Jr.
*Assistant Examiner*—Benjamin R. Fuller
*Attorney, Agent, or Firm*—Owen, Wickersham & Erickson

[57] ABSTRACT

A data registering device for use with machine-processable record punch cards includes a punch card frame supporting resilient strips for receiving punched-out chad pieces which are pushed between the strips by a hand-held stylus. The device further includes a lower card guide attached at a head end of the punch card frame and an upper card guide connected to the lower card guide. The two card guides are adapted to receive the punch card between them. A stylus-guiding template is slidably positioned over the resilient strips for receiving in registry the punch card immediately below. The device improves on prior constructions by providing a removable press-fit attachment connecting the lower card guide with the punch card frame, for permitting removal of the lower card guide from the punch card frame and replacement of the resilient strips when required.

15 Claims, 11 Drawing Figures

PUNCH FRAME FOR DATA REGISTERING DEVICE

BACKGROUND OF THE INVENTION

The invention relates to card punching data recording devices, more specifically punch card voting devices, which are adapted to operate upon tabulating cards of the kind in which the index-point area of each card are individually scored to provide selectively removable "chips" or punchouts commonly referred to as "chad."

Devices of this kind are disclosed in Harris U.S. Pat. Nos. 3,201,038 and 3,240,409. In such data recording devices, the instrument employed to remove the card material does not have a cutting or shearing action in the manner of an ordinary punch. Rather, it functions merely to apply to a selected chip sufficient force to break the frangible connections between that chip and the card, thereby detaching the chip from the card. The expressions "punch" and "punching," as employed herein, should be understood to have this meaning. Similarly, reference made herein to a "die" should not be construed as meaning a die of the kind in which a shearing action takes place.

Card punching devices of the aforesaid type commonly include a punch board or die comprising parallel strips of thin, resilient material that are adapted to provide a firm support for the main body of the card and to yield wherever necessary to permit the passage of a chip of card material as the same is pushed out of the card and between adjacent strips by the punching tool. When such a punch board or die is utilized, precautions must be taken to insure that all of the chips punched from the card are expelled from between the resilient die strips and that none of these chips will remain caught in the grip of the tightly spaced resilient strips after the punching tool is withdrawn. If chips are permitted to accumulate between the resilient strips, this can interfere with the punching operations, and occasionally it has been observed that a partially punched chip has been left clinging to a card after the punch was withdrawn, because the card-supporting surface of the punch board had become so clogged with chips as to prevent a clean punching operation. Incompletely punched cards can cause serious errors to occur in data processing operations utilizing such cards.

In punch card voting devices, a template has been used to guide the voter's punch or stylus onto the selected punch position. If, however, the voter does not hold the voting punch straight up and down when punching, it is possible under certain temperature and humidity conditions to pull the template toward the voter a few thousandths of an inch, sufficient to prevent complete removal of the chad when the stylus is inserted. This can produce what is called a "hanging chad," as the chad-piece of the card is still attached to the card by one or two of the frangible holding points.

Through analysis and experience, it has been found that the construction of the punch boards is principally responsible for these problems. It must be emphasized that the presence of even one incompletely punched chip in a run of several thousand tabulating cards is in most cases too great a defect to be tolerated. Hence, the design of the punch board becomes a critical and important factor in the successful use of prescored tabulating cards.

Punch boards which have been in use in punch card voting have employed a highly heat-sensitive material, ABS plastic, which causes the card, template, and template stops or abutments of the punch board to move away from their ideal registration location as the temperature rises or falls. Specifically, the template stops of the punch-bed, or punch frame as it is called in punch card voting, should be within a 0.007 inch tolerance zone for proper operation of the punch card voting device. With the ABS plastic, as has been used, having an expansion characteristic which allows 0.0005 inch longitudinal growth or expansion over the length of the punch frame per degree Fahrenheit, it is easily seen that the critical dimensions are exceeded when 14° F. variations from an average 72° F. are exceeded in a polling place, i.e., over 86° F. or under 58° F. Temperatures over 86° F. or under 58° F. may be found in garages, gymnasiums, halls, etc., which are used as polling places. Therefore, the material typically used for punch boards in punch card voting can and does contribute to potentially unreadable votes, because of hanging chad or mispunched cards.

As previously constructed, punch card data recording devices were difficult or impossible to dismantle for removal and replacement of the resilient die strips, or costly assemblies were employed to enable such dismantling. There has been a need for a simple, inexpensive system of assembly which permits easy, nondesctructive separation of components, particularly in the connection of the lower card guide with the punch card frame body.

Another shortcoming of prior punch card recording devices has been the requirement of milling or machining the template and card positioning stops or abutments of the punch frame. The card positioning stops were molded into the plastic punch frame to limit the travel of the template and card as the card barely slips over the pins at the top or head end of the punch frame. The distance between the pins and the stops is quite critical and must be precisely controlled. However, because of the tolerance build-up and difficulty in repeat molding each part and assembling all together within a few thousandths of an inch tolerance, it was found that an expedient way to correct the inaccuracies of molding and assembly was to machine the distance from the pins to the template stops in order to obtain the correct dimension. Machining was performed on the stops after assembly. This has been necessary because of the method of assembly and the materials used. Methods of assembly have typically used solvent bonding, which melts some of the material of parts to be joined, then, when the solvent evaporates, leaves the parts joined together. Obviously, a machining operation is costly, and there has been a need for a simplified means of obtaining accurate spacing from the pins to the stops, without post-assembly machining.

Another defect of prior art punch frames has been that in order to retain the template in the device in its proper position during and between uses, a template retaining clip has been employed. The clips have often been installed improperly and have interfered with the template, causing the voting device to malfunction.

SUMMARY OF THE INVENTION

The present invention provides an improved data registering device for use with machine-processable record punch cards, having at the head end of the device upper and lower card guides which are secured together and to the punch card frame in a unique and advantageous manner. The lower card guide attaches to the punch card frame by means of dovetail-shaped tabs and grooves, sized to provide an interference fit, so that the two components are pressed together snugly and firmly. A screw may be installed between the components for additional retention. This enables removal of the card guide from the frame, for replacement of the resilient die strips supported by the punch card frame. The resilient strips, between which the punched out chips or chad pieces are pushed during use, eventually wear and require replacement.

The upper card guide, which includes the pins for registry with and retention of the punch card, is received on the lower card guide by means of flat surfaces and a ridge and groove arrangement, allowing slidable adjustment of the relative positions of the upper and lower card guides before the two are permanently bonded together by solvent or ultrasonic bonding. Bonding of the two card guides is performed after the lower card guide is secured to the punch card frame. This assures accurate attainment of the prescribed distance between the card-retaining pins and the stops or abutments at the opposite end of the punch card frame, and eliminates the need to machine the stops for attaining the precise distance.

The perforated, transparent plastic punch card template, which is positioned over the resilient strips so as to receive the punch card between the template and the resilient strips, has at its foot end a light leaf-type spring, lightly urging the template and the punch card together toward the head end of the punch card frame. The spring, and the foot end of the template, are retained in the frame by an advantageous unitary memory which includes cover plates above the ends of the spring and also includes the abutments. The unitary member, which avoids the problems of prior template-retaining arrangements discussed above, can be fitted onto prior art punch card data registering devices, simplifying them and increasing reliability.

By using glass-reinforced plastic or other reinforced plastic resins to manufacture the punch frame, the high-expansion characteristics of ABS plastic, typically used in the manufacture of punch frames, can be corrected to the extent that a more accurate part is produced which would not require milling of the stops for the template, even if the adjustable card guide system of the invention were not used. By using filled plastic materials, the problems of high expansion characteristics of prior devices can be vastly improved. Previous punch frames allow mis-registration with the card and template at extreme temperatures of 40° to 50° F. or 90° to 110° F. resulting, as described previously, in one of the main detractors of punch card voting: "hanging chad." Ideally, the card to template and stop relationship should remain the same at any operating temperature—perhaps about 40° to 110° F. Previous punch frames would expand or shrink 0.017 inch when raised or lowered to either extreme from a median 75° F. operating temperature. When glass reinforcement or filled plastics are used, the above expansion can be reduced to less than 0.005 inch, or less than one-third the expansion. A tolerance of 0.005 inch is within the nominal tolerance acceptable for manufacture of punch frames at 72° F.; i.e., the reinforced punch frame, having an expansion factor one-third that of ABS, will keep the punch frame in specification over its operating temperature range. Materials are available which can be advantageously molded into this part, with economy and with the desirable expansion characteristics.

The above-described system for connection of the upper card guide to the lower card guide assures proper precision spacing between the pins and the template stops by providing for adjustment of the pin-bearing upper card guide before the upper and lower card guides are bonded together. The assembly process corrects any molding deficiencies as well as material irregularities, adding further to the improvements provided by the use of reinforced plastic material, and in fact in itself avoiding the need for machining operations. With prior devices and assembly systems, there was no method of correcting for material irregularities at assembly. Furthermore, by using the present assembly system, accidental errors in assembly can still be corrected by unfastening the punch frame bed from the lower card guide and shimming or grinding.

There are several embodiments of the invention, each for inclusion in a data registering device for use with a machine-processable record punch card and including a punch card frame supporting resilient strips for receiving punched-out chad pieces pushed between the strips by a hand-held stylus. In such devices there is a lower card guide attached at a head end of the punch card frame, an upper card guide connected to the lower card guide, the card guides being adapted to receive the punch card between them, and a stylus-grinding template slidably positioned over the resilient strips for receiving in registry the punch card immediately below. In one embodiment, the improvement comprises removable press-fit attachment means connecting the lower card guide with the punch card frame, for permitting removal of the lower card guide from the punch card frame and replacement of the resilient strips when required. The press-fit attachment means may comprise dovetail-shaped grooves oriented generally vertically on the head end of the punch card frame and complementarily shaped tabs on the lower card guide, with the tabs and grooves being sized to provide a tight interference fit for secure, stable connection. In another embodiment of the invention the improvement to a data registering device of the type described comprises adjustable connection means between the upper card guide and the lower card guide, for enabling precise attainment of the prescribed distance between the pins and the stops during assembly, before the upper and lower card guides are secured together.

Accordingly, it is a broad object of the invention to improve the reliability of devices for punching data in prescored tabulating cards, to the end that all punched chips will be completely removed from the card and from the resilient die strips, with no possibility of a chip being left in a position where it can have a harmful effect.

It is a further object to provide an improved assembly of a punch card type data registering device wherein the resilient strips are readily replaceable when required.

Another object is to provide an assembly wherein the critical distance between card-retaining pins at the head end of the device and abutment stops at the foot end may be precisely controlled on assembly, without machining of the stops.

A further object is to provide an attachment for the foot end of a punch card data registering device, for inclusion in a new assembly or fitting on a prior art device, with provision for retaining the punch card template in the frame and also including the abutment stops for engagement by the punch card and the template.

FIG, 5 is a fragmentary plan view showing the head end of the punch card frame, and illustrating grooves for receiving the lower card guide.

Figure 6:
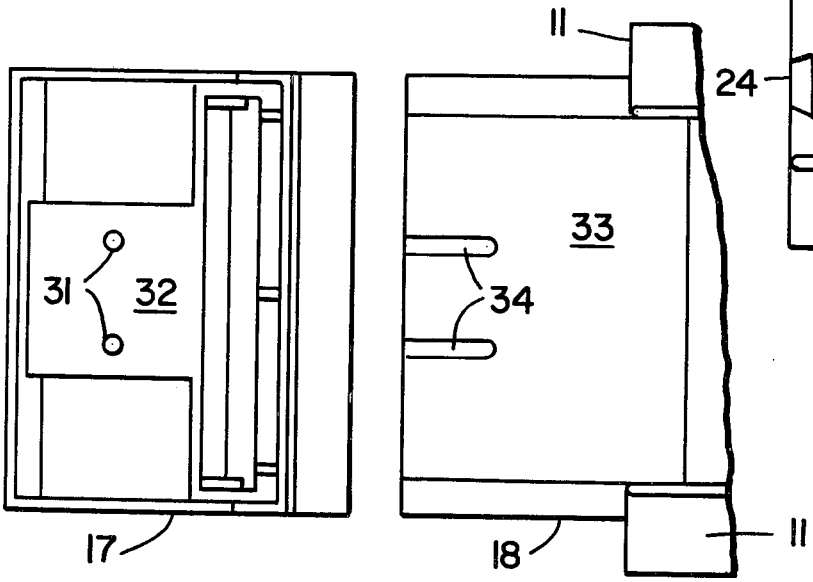

FIG. 6 is an exploded view showing the bottom of the upper card guide and the top of the lower card guide with a portion of the attached punch card frame, and indicating the manner of assembly of the upper card guide to the lower card guide.

Figure 7:
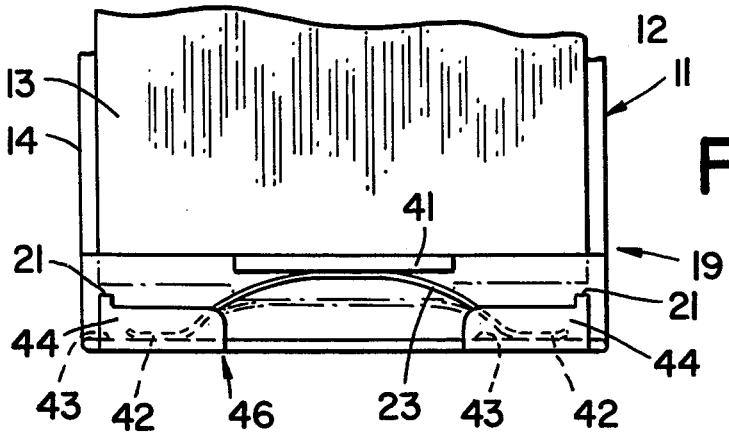

FIG. 7 is a fragmentary plan view showing the foot end of the punch card frame, with the punch card template and a spring at its foot end indicated.

Figure 8:
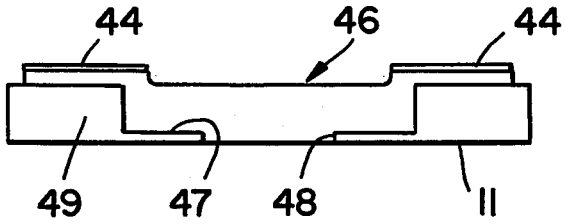

FIG. 8 is an elevation view of the foot end of the punch card frame, having assembled therein a unitary member for providing template stops and for retaining the template in position on the punch card frame.

Figure 9:
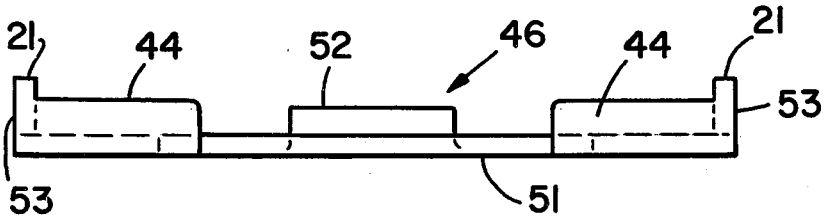

FIG. 9 is an enlarged plan view of the unitary member shown in FIG. 8, before assembly in the punch card frame.

Figure 10:
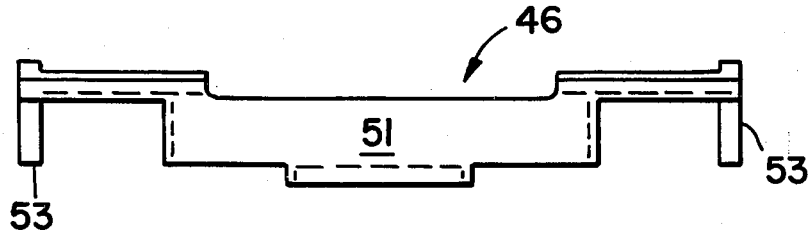

FIG. 10 is a rear elevation view of the unitary member.

Figure 11:
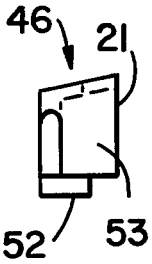

FIG. 11 is a side view of the unitary member.

DESCRIPTION OF THE PREFERRED EMBODIMENTS

Figure 1:
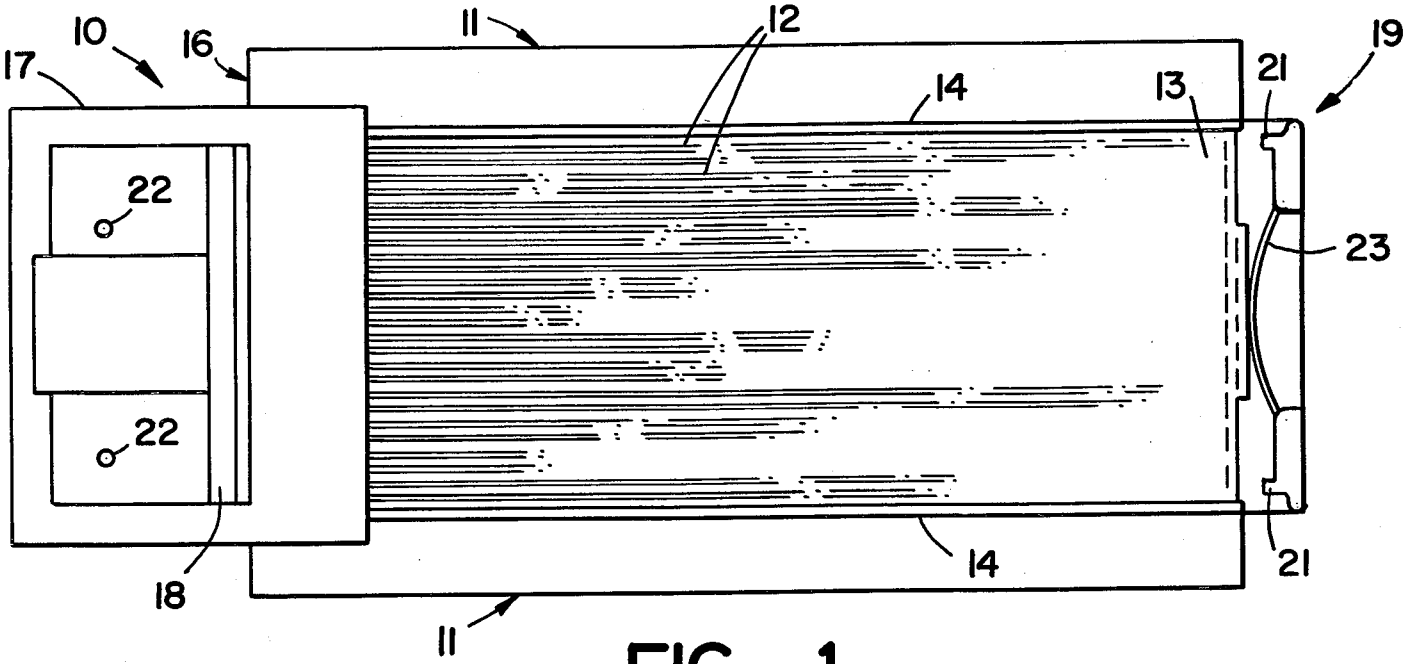
FIG. 1 is a plan view of a punch card type data recording device including improvements according to the invention.
Figure 2:
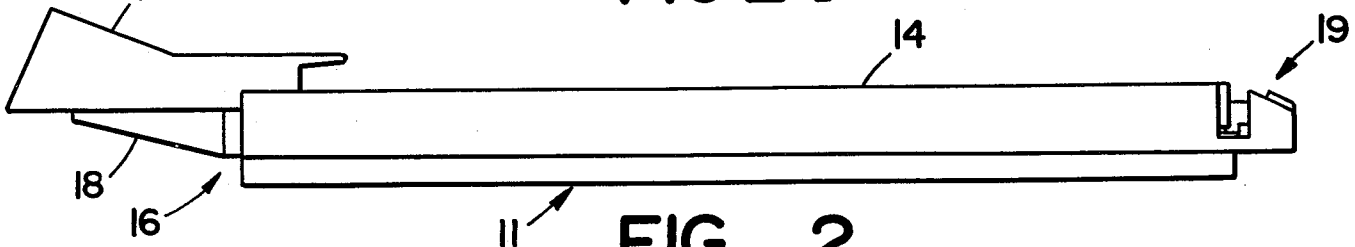
FIG. 2 is a side view of the device of FIG. 1.
Figure 3:
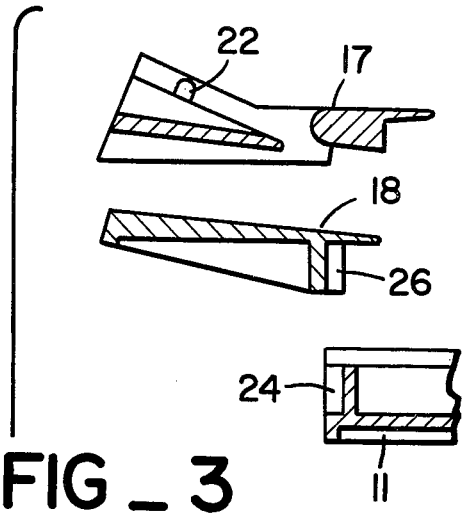
FIG. 3 is an exploded assembly view indicating the manner of assembly of the punch card frame to the lower card guide, with the components shown in elevational section.

In the drawings, FIG. 1 shows a punch card type data recording device 10 including a punch card frame 11 supporting a series of resilient die strips 12, with a transparent, perforated punch card template 13 positioned over the strips 12 and between upwardly extending flanges 14 of the frame 11. At the head end 16 of the device is an upper card guide 17, connected to a lower card guide 18 below. These components are also seen in FIG. 2.

At the foot end 19 of the punch card frame 11 are a pair of abutments or stops 21 against which the punch card template and a data recording punch card (not shown) are together engaged when the card is inserted into the device 10 and pushed into place with top end holes slipped over upwardly extending pins 22. A leaf-type spring 23 is connected to the foot end of the template 13 and lightly urges the template (and the punch card, when in place) away from the stops 21.

As thus far described, the components of the data registering device 10 have all been included in conventional equipment, except that the form of the components and the manner in which they interrelate and are connected to one another are different according to the invention.

Figure 4:
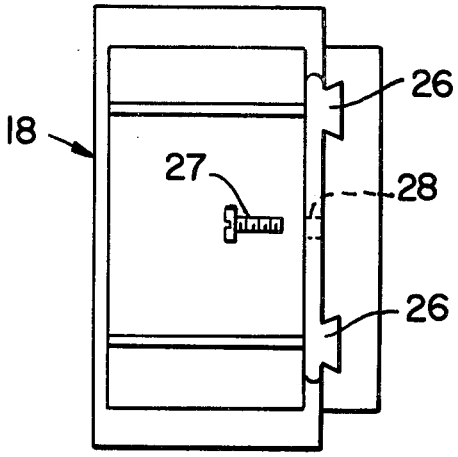
FIG. 4 is a bottom plan view of the lower card guide, showing dovetail-shaped tabs for engaging the punch card frame.
Figure 5:
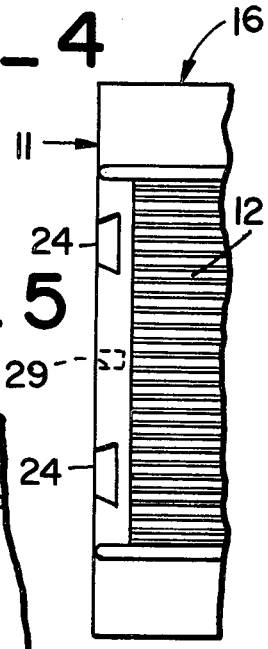

FIGS. 3,4,5, and 6 indicate the manner of assembly of the punch card frame 11, the lower card guide 18 and the upper card guide 17. As illustrated, the punch card frame 11 includes at its head end 16 a pair of dovetail-shaped grooves 24, formed in the plastic frame 11 in the molding process and aligned generally vertically. On the lower card guide 18 are complementarily shaped tabs 26, sized for a tight interference fit with the grooves 24. The bottom of the lower card guide is shown in FIG. 4, revealing the tabs 26. When the two components are assembled, as can be envisioned from FIG. 3, the tabs 26 are forced downwardly into the grooves 24, and a tight, rigid connection results. For additional security, a screw fastener 27 may be used, passing through a hole 28 in the lower card guide 18 to be screwed into a bore 29 in the frame 11. As discussed above, this method and system of assembly permits easy, nondestructive dismantling, so that the resilient die strips 12 may be replaced when required.

The manner in which the upper card guide 17 is assembled to the lower card guide 18 is also unique and advantageous. FIG. 6 shows the bottom of the upper card guide, to reveal a pair of projecting bumps or ridges 31 on a downwardly facing surface 32 which upon assembly engages against an upwardly-facing surface 33 of the lower card guide 18. The bumps or ridges 31 register with parallel longitudinal grooves 34 in the lower card guide surface 33. Thus, upon assembly the upper card guide is held in alignment and permitted to slide longitudinally along a track for adjustment prior to bonding of the components together. As discussed previously, the distance between the card-retaining pins 22 and the stops 21 (see FIG. 1) at the foot end of the punch card frame 11 is critical and must be precisely controlled. To this end, a jig (not shown) having the desired spacing is placed against the stops 21 and adjacent to the pins 22. The upper card guide position is then adjusted, with respect to the lower card guide below, until the pins 22 engage the jig properly. That position of the upper card guide is held and the two card guides are bonded together, either by ultrasonic bonding or solvent bonding.

FIGS. 7–11 show details at the foot end 19 of the punch card frame 11. The punch card template 13, retained by the side flanges 14 for limited longitudinal movement in the punch frame, has the leaf spring 23 secured to a flange 41 at the foot end of the template. The flange 41 extends downwardly for supporting the spring and to act as a stop for the punch card to engage against when it is inserted. As indicated, ends 42 of the spring 23 extend laterally and engage against a wall 43 secured at the foot end of the frame 11. According to the invention, the template 13 is retained in place against lifting out of the frame 11 by a pair of spaced apart, plate-like covers 44 at either side. Of course, at the head end of the frame, that end of the template is prevented from being lifted out of the frame by the overhanging upper card guide 17.

Another advantageous feature of the invention is that the stops 21 and the covers 44 at the foot end of the device are provided by a unitary member 46, shown installed in the punch card frame 11 in FIGS. 7 and 8 and shown prior to installation in FIGS. 9–11. As shown in FIGS. 7 and 8, the unitary member 46 has the plate-like covers 44 at the sides, just above the spring ends 42, but with a large central area between the covers 44 left open. Thus, the template can be removed from the frame if desired, by forcing the ends of the spring toward the template using a tool or even a finger.

The unitary member 46 is installed in the punch card frame 11 via cut-out areas 47 and 48 in the rear wall 49 and bottom of the frame 11. The cut-outs can be molded in the frame when it is manufactured, or they can be cut into an existing punch frame for fitting the member 46 in to improve the operation and reliability of the existing device. The member 46 perfectly is secured into the punch card frame body 11 by ultrasonic or solvent bonding.

The member 46 is shown in plan, rear elevation, and side views in FIGS. 9, 10 and 11. It comprises an integrally molded component having a back wall plate 51 supporting the upper plate-like members or flanges 44, a bottom, forward-extending flange 52 and side flanges 53 which extend forward a short distance to form the stops 21. As shown in FIGS. 10 and 11, the plates 44, as well as the top surfaces of the side flanges 53, may angle upwardly in the forward direction to some extent.

As discussed above, it is preferable that at least the punch card frame 11 be made of a filled plastic material, such as glass reinforced plastic, to reduce the coefficient of thermal expansion. This helps assure proper punch-out of the chad pieces in a data card over a wide range of temperature conditions.

The above described preferred embodiment is illustrative and is not intended to be in any sense limiting. Various other embodiments and variations to this preferred embodiment will be apparent to those skilled in the art and may be made without departing from the spirit and scope of the following claims.

I claim:

1. In a data registering device for use with a machine-processable record punch card and including a punch card frame supporting resilient strips for receiving punched-out chad pieces pushed between the strips by a hand-held stylus, and further including a lower card guide attached at a head end of the punch card frame, an upper card guide connected to the lower card guide, said card guides being adapted to receive the punch card between them, and a stylus-guiding template slidably positioned over the resilient strips for receiving in registry the punch card immediately below, the improvement comprising removable press-fit attachment means connecting the lower card guide with the punch card frame, for permitting removal of the lower card guide from the punch card frame and replacement of the resilient strips when required.

2. The device of claim 1, wherein the removable press-fit attachment means comprises dovetail-shaped grooves oriented generally vertically on the head end of the punch card frame and complementarily shaped tabs on the lower card guide, said tabs and grooves being sized to provide a tight interference fit for secure, stable connection.

3. The device of claim 1, wherein the punch card frame further includes a foot end having stops for engagement by ends of the punch card and the template, said stops being set a predetermined distance from upwardly-extending pins on the upper card guide for engagement with the opposite end of the punch card, and including adjustable connection means between the upper card guide and the lower card guide, for enabling precise attainment of said predetermined distance between the pins and the stops during assembly, before the upper and lower card guides are secured together.

4. The device of claim 3, wherein the adjustable connection means comprises complementarily shaped, slidably enagagable surfaces between the upper and lower card guides, said card guides being of plastic material and secured together by solvent bonding.

5. The device of claim 3, wherein the punch card frame is of reinforced plastic material, for a low coefficient of thermal expansion.

6. The device of claim 1, wherein the punch card frame further includes a foot end having stops for engagement by foot ends of the punch card and the template, said stops being set a predetermined distance from upwardly-extending pins on the upper card guide for engagement with the opposite end of the punch card, said slidable template having a leaf type spring secured to its foot end, engaged against the foot end of the punch card frame and lightly urging the template toward the head end of the punch card frame, said spring having laterally extending ends, the foot end of the punch card frame including a portion having spring retaining covers positioned above the ends of the spring to normally hold the spring and template from lifting out of the punch card frame, said portion also including said stops, integrally formed therein.

7. In a data registering device for use with a machine-processable record punch card and including a punch card frame supporting resilient strips for receiving punched-out chad pieces pushed between the strips by a hand-held stylus, and further including a lower card guide attached at a head end of the punch card frame, an upper card guide connected to the lower card guide, a stylus-guiding template slidably positioned over the resilient strips for receiving in registry the punch card immediately below, and a foot end on the punch card frame having stops for engagement by ends of the punch card and the template, said stops being set a predetermined distance from upwardly-extending pins on the upper card guide for engagement with the opposite end of the punch card, the improvement comprising adjustable connection means between the upper card guide and the lower card guide, for enabling precise attainment of said predetermined distance between the pins and the stops during assembly, before the upper and lower card guides are secured together.

8. The device of claim 7, wherein the adjustable connection means comprises complementarily shaped, slidably engagable surfaces between the upper and lower card guides, said card guides being of plastic material and secured together by solvent bonding.

9. The device of claim 7, wherein said slidable template has a leaf type spring secured to its foot end, engaged against the foot end of the punch card frame and lightly urging the template toward the head end of the punch card frame, said spring having laterally extending ends, the foot end of the punch card frame including a portion having spring retaining covers positioned above the ends of the spring to normally hold the spring and template from lifting out of the punch card frame, said portion also including said stops, integrally formed therein.

10. The device of claim 7, wherein the punch card frame is of reinforced plastic material, for a low coefficient of thermal expansion.

11. A data registering device for use with a machine-processable record punch card, said device being of the type which includes a punch card frame having a head end and a foot end and supporting resilient strips for receiving punched-out chad pieces pushed between the strips by a hand-held stylus, a lower card guide attached at the head end of the punch card frame, an upper card guide connected to the lower card guide, and a stylus-guiding template slidably positioned over the resilient strips for receiving in registry the punch card immediately below, said template having a leaf type spring secured to its foot end, engaged against the foot end of the punch card frame and lightly urging the template toward the head end of the punch card frame, said spring having laterally extending ends, the foot end of the punch card frame having a unitary portion including stops positioned for engagement by ends of the punch card and the template, said stops being set a predetermined distance from upwardly-extending pins on the upper card guide for engagement with the opposite end of the punch card, and said unitary portion also including spring retaining cover means positioned above the ends of the spring to normally hold the spring and template from lifting out of the punch card frame.

12. The device of claim 11, wherein the spring retaining cover means comprises a pair of plate-like portions extending laterally from a central body portion, said plate-like portions being spaced apart to provide a central access opening to the spring.

13. For installation on a data registering device for use with a machine-processable record punch card, said device being of the type which includes a punch card frame having a head end and a foot end and supporting resilient strips for receiving punched-out chad pieces pushed between the strips by a hand-held stylus, a lower card guide attached at the head end of the punch card frame, an upper card guide connected to the lower card guide, and a stylus-guiding template slidably positioned over the resilient strips for receiving in registry the punch card immediately below, said template having a leaf type spring secured to its foot end, engaged against the foot end of the punch card frame and lightly urging the template toward the head end of the punch card frame, said spring having laterally extending ends, the improvement comprising a unitary attachment for the foot-end of the punch card frame, said attachment including stops positioned to be engaged by ends of the punch card and the template, said stops to be set a predetermined distance from upward-extending pins on the upper card guide for engagement with the opposite end of the punch card, and said unitary attachment also including spring retaining cover means positioned above the ends of the spring to normally hold the spring and template from lifting out of the punch card frame.

14. The unitary attachment of claim 13, wherein the spring retaining cover means comprises a pair of plate-like portions extending laterally from a central body portion, said plate-like portions being spaced apart to provide a central access opening to the spring.

15. The unitary attachment of claim 14, wherein the stops comprise abutments depending from the lateral extremities of the plate-like portions, being positioned for orientation toward the head end of the punch card frame.

* * * * *